US005425590A

United States Patent [19]

Duty et al.

[11] Patent Number: 5,425,590

[45] Date of Patent: Jun. 20, 1995

[54] DISPOSABLE TOOTHBRUSH APPARATUS

[76] Inventors: Billy G. Duty, Rte. 2, Box 201; Ellen McClanahan, Rte. 2, Box 209-A; Randy Newberry, Rte. 2, Box 245-A, all of Grundy, Va. 24614

[21] Appl. No.: 207,625

[22] Filed: Mar. 9, 1994

[51] Int. Cl.[6] ..... A46B 11/02

[52] U.S. Cl. ..... 401/176; 401/179; 401/182; 401/288; 222/391

[58] Field of Search ..... 401/176, 179, 182, 171, 401/288; 222/391

[56] References Cited

U.S. PATENT DOCUMENTS

| | | | |
|---|---|---|---|
| 1,212,010 | 1/1917 | Brown | 401/278 X |
| 1,810,074 | 6/1931 | Friedlander | 401/288 |
| 2,033,197 | 3/1936 | Kinkade | 401/278 X |
| 2,243,774 | 5/1941 | Resh | 401/179 X |
| 2,488,638 | 11/1949 | O'Connor | 401/179 |
| 5,039,244 | 8/1991 | Cheng | 401/179 X |

FOREIGN PATENT DOCUMENTS

| | | | |
|---|---|---|---|
| 25472 | 5/1952 | Finland | 401/179 |
| 2597734 | 10/1987 | France | 401/176 |

*Primary Examiner*—Steven A. Bratlie

[57] ABSTRACT

A disposable toothbrush apparatus is provided having a head, a bristle cluster extending from the head and a hollow handle for defining a toothpaste storage chamber connected to the head. A manually actuatable pump assembly mounted for axial displacement at the distal end of the handle storage chamber is adapted to cause a predetermined amount of toothpaste in the chamber to be fed via a conduit to a nozzle opening in a surface of the head at the base of the bristle cluster. In an alternative embodiment, a refillable cartridge containing a fresh supply of toothpaste and the self-contained pump assembly is adapted to be fitted to the hollow handle.

12 Claims, 5 Drawing Sheets

FIG 3
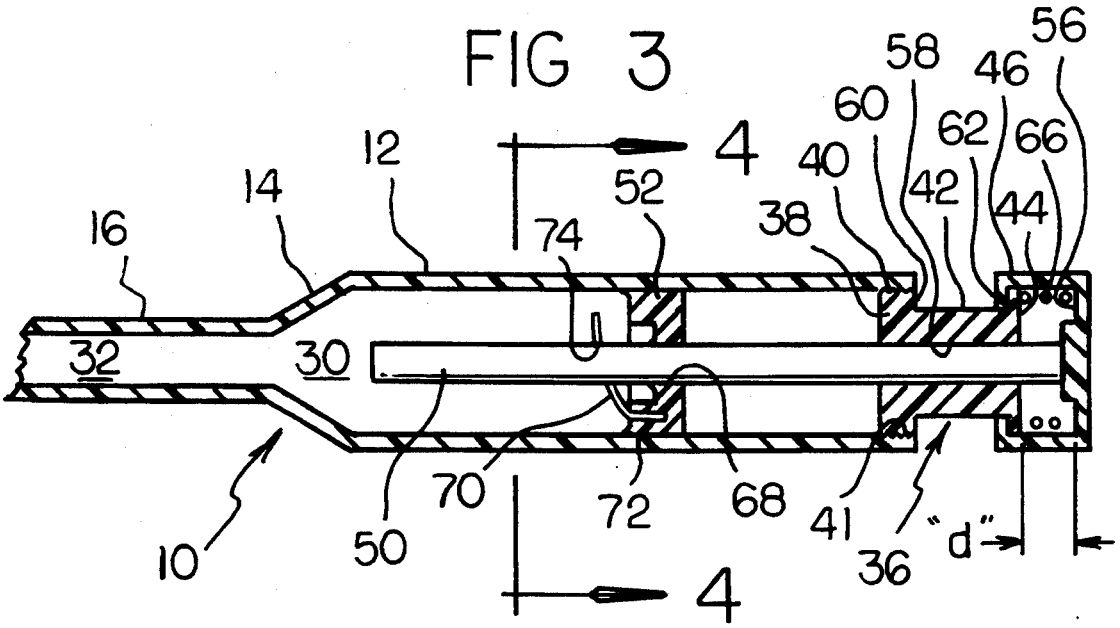
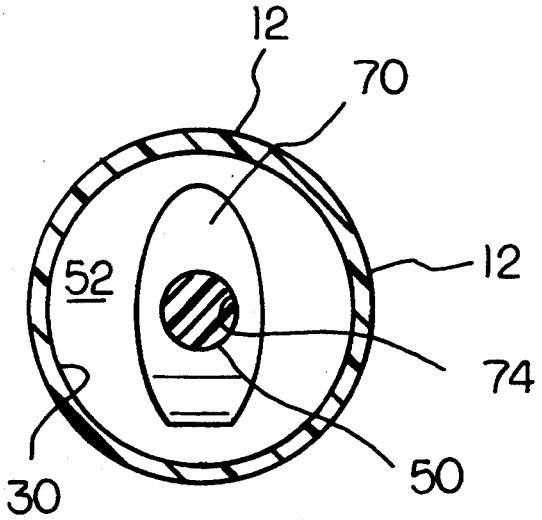
FIG 4

FIG 6
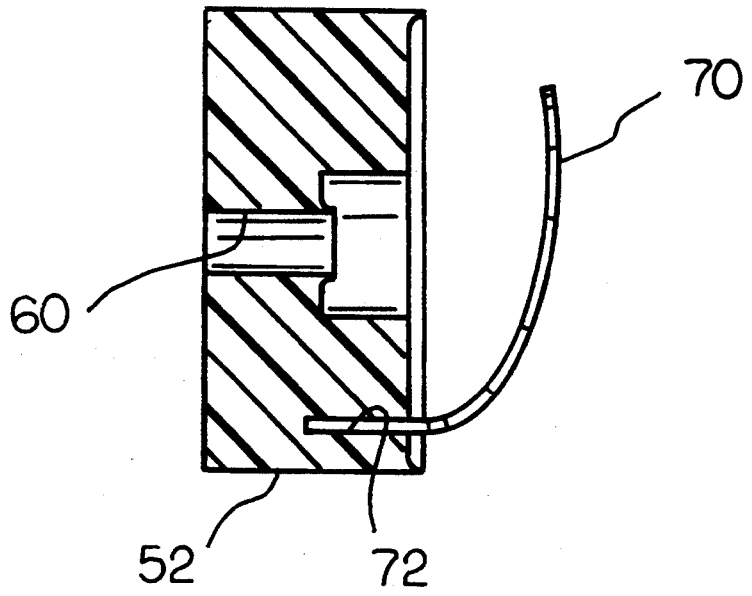
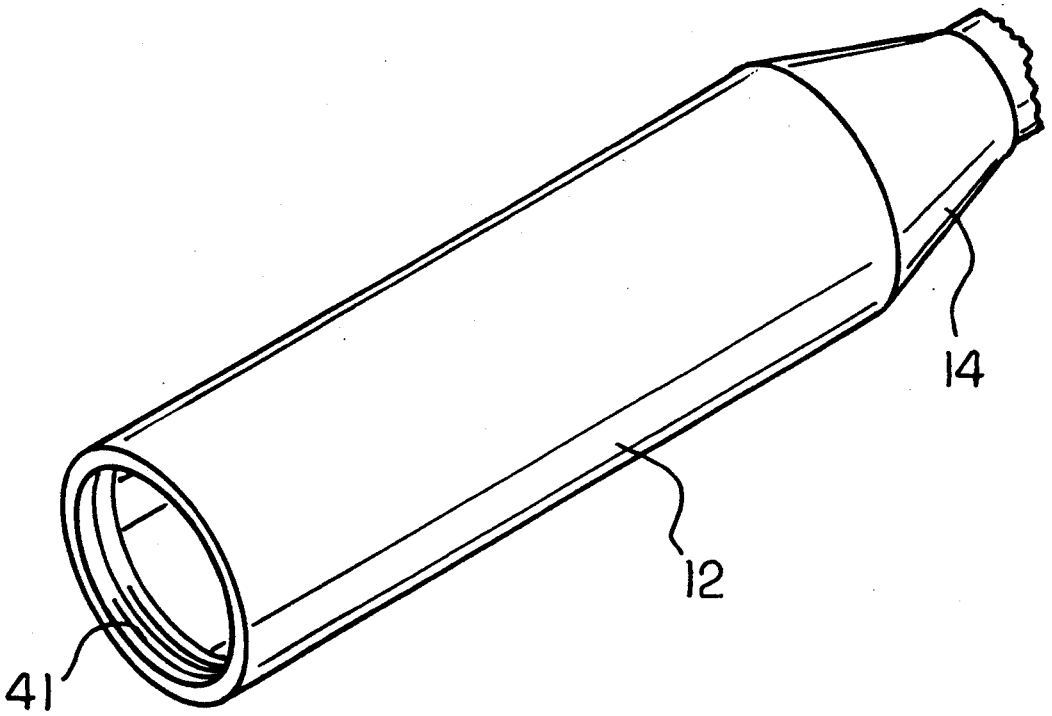
FIG 7

DISPOSABLE TOOTHBRUSH APPARATUS

BACKGROUND OF THE INVENTION

1. Field of the Invention

The present invention relates generally to toothbrushes, and more particularly, to a toothbrush apparatus having a self-contained supply of toothpaste therein.

2. Description of the Prior Art

It has long been desired to provide a disposable toothbrush apparatus characterized by the familiar elongated handle terminating in a head with bristles and which furthermore, conveniently contains a quantity of toothpaste or other dentifrice stored in the elongated handle. Such an apparatus has obvious advantages of convenience because it dispenses with a separate toothpaste container. Ideally, an effective toothbrush apparatus of this type will possess the following additional advantages: (1) it will be simple in construction, having relatively few parts, and thereby be low in cost; (2) it will be able to store a sufficient amount of toothpaste suitable for several applications; (3) it will have a convenient and simple actuator for repeatedly and selectively transferring a predetermined amount of the stored toothpaste quantity to the bristles for each cleaning cycle; (4) it will capable of being easily recharged with a fresh supply of toothpaste to permit, if desired, reuse; and (5) it will be durable, yet light in weight and compact in size.

A toothbrush apparatus meeting the foregoing desideratum is met by the present invention as will be made apparent from the following description thereof. Other advantages of the present invention over the prior art also will be rendered evident.

SUMMARY OF THE INVENTION

To achieve the foregoing and other advantages, the present invention, briefly described, provides a disposable toothbrush apparatus having a head, a bristle cluster extending from the head and a hollow handle for defining a toothpaste storage chamber connected to the head. A manually actuatable pump assembly mounted for axial displacement at the distal end of the handle storage chamber is adapted to cause a predetermined amount of toothpaste in the chamber to be fed via a conduit to a nozzle opening in a surface of the head at the base of the bristle cluster. In an alternative embodiment, a refillable cartridge containing a fresh supply of toothpaste and the self-contained pump assembly is adapted to be fitted to the hollow handle.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toothbrush apparatus which has all of the advantages of the prior art and none of the disadvantages. It is another object of the present invention to provide a new an improved toothbrush apparatus which may be easily and efficiently manufactured and marketed.

It is a further objective of the present invention to provide a new and improved toothbrush apparatus that is of durable and reliable construction.

An even further object of the present invention is to provide a new and improved toothbrush apparatus susceptible of a low cost of manufacture with regard to both materials and labor, and which accordingly is then susceptible of low prices of sale to the consuming public, thereby making such toothbrush apparatus available to the buying public.

Still yet a further object of the present invention is to provide a new and improved toothbrush apparatus that is portable and conveniently small in size facilitating easy storage thereof.

Yet still another object of the present invention is to provide a new and improved toothbrush apparatus that may be disposed of after a predetermined number of cycles of use.

Another object of the present invention is to provide a new and improved toothbrush apparatus that includes a head having bristles, a hollow handle attached to the head for defining a toothpaste storage chamber, and a manually actuatable pump assembly mounted for axial displacement at the distal end of the handle storage chamber for enabling a predetermined amount of toothpaste in the chamber to be fed via a conduit to a nozzle at the base of the bristle cluster on the head of the toothbrush apparatus.

Still a further object of the present invention is to provide a new and improved toothbrush apparatus having a hollow handle and a refillable cartridge containing a fresh supply of toothpaste and a self-contained pump assembly adapted to be fitted to the hollow handle.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference now should be had to the accompanying drawings and descriptive matter in which there are illustrated mostly preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3 is an elevational cross-sectional view of the handle portion of the toothbrush apparatus of FIG. 1 taken along line 3—3 thereof.

FIG. 4 is an elevational cross-sectional view of the handle portion of the toothbrush apparatus of FIG. 1 taken along line 4—4 thereof.

FIG. 6 is a cross-sectional enlarged elevational view taken along line 6—6 of FIG. 5 showing the details of the piston head.

FIG. 7 is a perspective view of the handle of an alternative preferred embodiment of the toothbrush apparatus of the present invention.

DESCRIPTION OF THE PREFERRED EMBODIMENT

Figure 1:
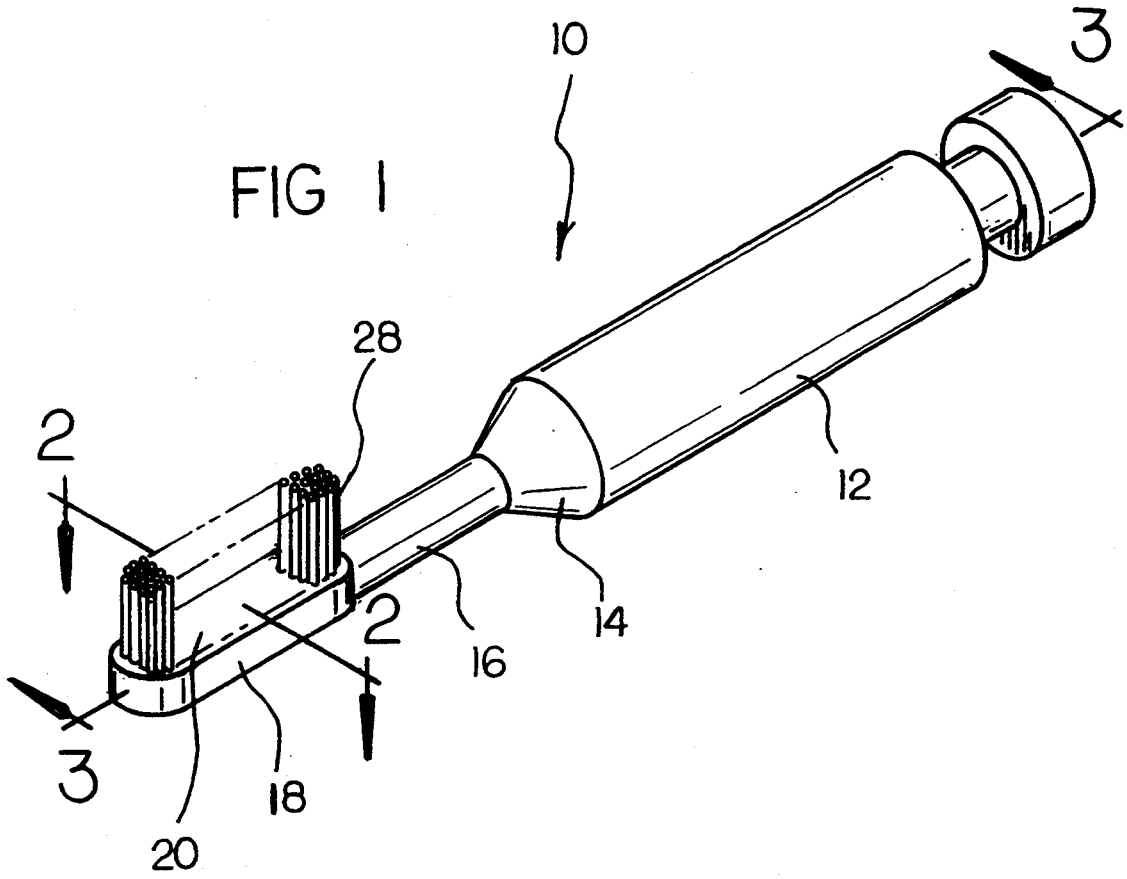
FIG. 1 is a perspective view showing the first preferred embodiment of the toothbrush apparatus of the invention.
Figure 2:
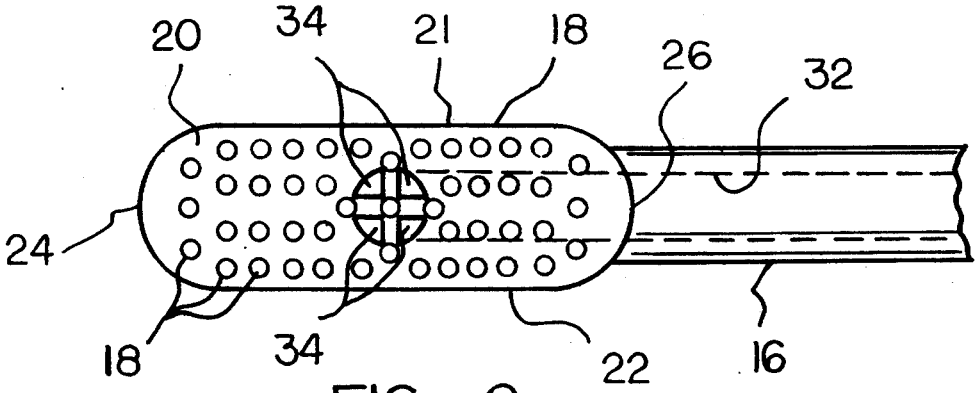
FIG. 2 is a plan view of the head and bristle portion of the toothbrush apparatus of FIG. 1 taken along line 2—2 thereof.
Figure 5:
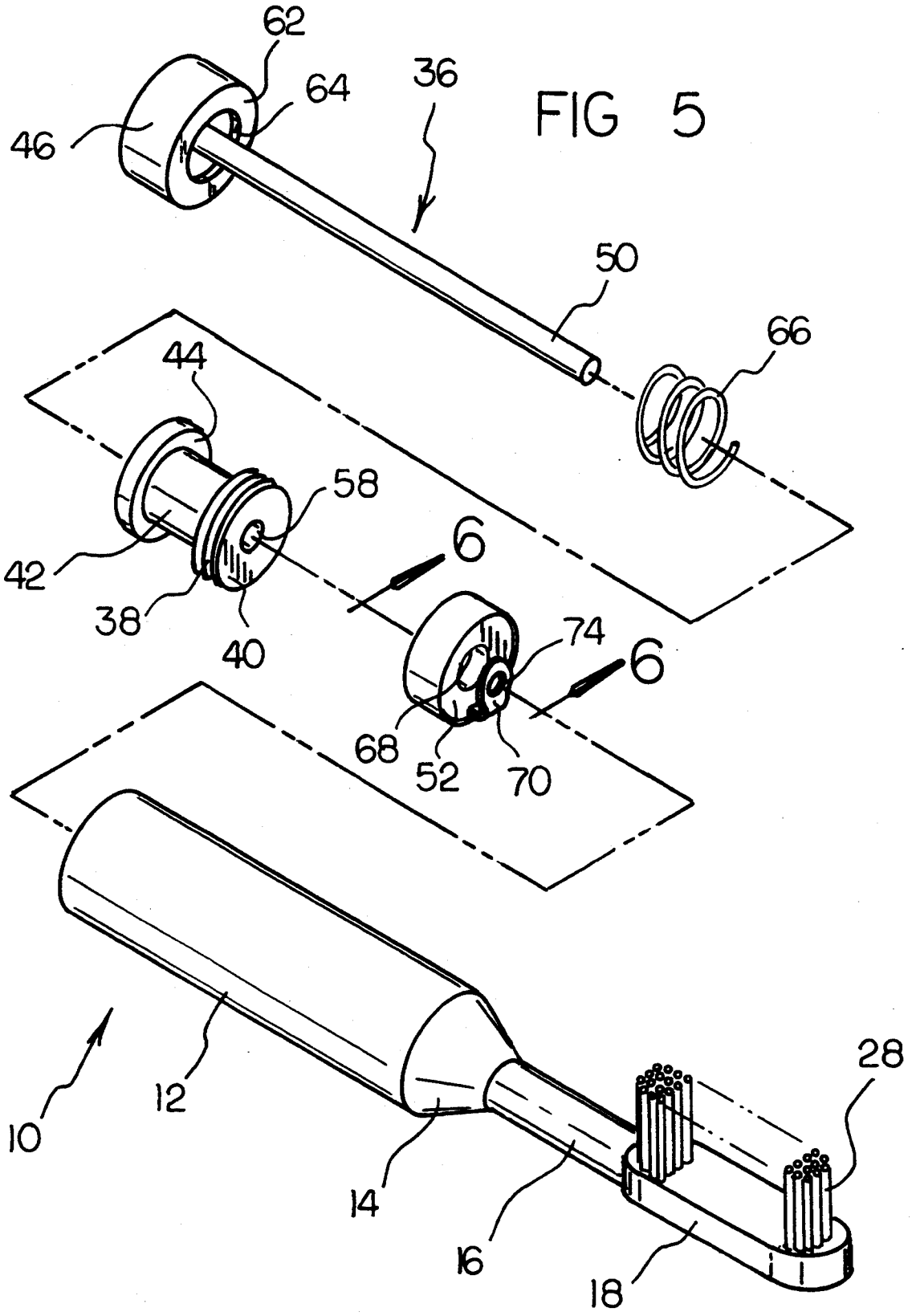
FIG. 5 is a perspective exploded assembly of the parts comprising the embodiment of the toothbrush apparatus illustrated in FIGS. 1 through 4.

With reference now to the drawings, a new and improved toothbrush apparatus embodying the principles and concepts of the present invention will be described.

Turning initially to FIGS. 1-6, there is shown a first preferred embodiment of the disposable toothbrush apparatus of the present invention generally designated by reference numeral 10. In a first preferred form, toothbrush apparatus 10 comprises a generally cylindrically shaped handle portion 12 of a first diameter, a conically shaped mid-portion 14, a generally cylindrically shaped necked-down portion 16 of a second diameter of reduced dimension relative to the first diameter of handle portion 12, and a head portion 18 having substantially flat opposed sides 20, 22 and opposed rounded end edges 24, 26, substantially as shown in the drawings, particularly FIGS. 1 and 2. Extending orthogonally from flat surface 21 are a multiplicity of flexible bristles 28 as is commonly used in the toothbrush art.

In accordance with the invention, handle portion 12 and mid-portion 14 are hollow to define an internal storage chamber 30 for receiving and storing therein a quantity of toothpaste or other dentifrice or teeth cleaning substance. In addition, a tubular conduit 32 extends axially from the first end of chamber 30 defined by conical mid-portion 14 through reduced diameter neck portion 16 to approximately the middle of head portion 18 where conduit 32 makes a right-angle turn and terminates in a series of sector shaped openings 34 disposed in a circular pattern substantially as shown in top surface 20 of head portion. By this arrangement, the toothpaste or other substance stored in chamber 30 selectively may be conveyed (via conduit 32) from chamber 30 in handle portion 12 to the base of bristles 28 (via openings 34) in a manner to be explained in greater detail below.

Turning now to FIGS. 1 and 3 through 5, an actuator assembly generally represented by reference numeral 36 seals off the cylindrical opening of chamber 30 at the rear or second end thereof. Actuator assembly 36 comprises a cylindrical plug member 38 coaxially supported in the bore of chamber 30 at the second end thereof via male threads 40 on the periphery of the plug member cooperatively engaging mating female threads 41 suitably provided on the inside surface of handle 12 proximal to the second or rear end thereof. The plug member 38 extends rearwardly and axially (FIG. 4) to form a reduced diameter cylindrical shank 42 terminating in an end flange 44 upon which shank cylindrical end cap 46 is adapted for relative slidable movement.

End cap 46 has suitably affixed thereto in a coaxial manner an elongated longitudinally and axially extending cylindrical connecting rod 50 which, in turn, has a slidable piston 52 mounted thereon. Piston 52 has a diameter slightly less than the bore or inside diameter of chamber 30 such that movement of piston 52 inside chamber 30 to the left as viewed in FIG. 4 is effective to cause any toothpaste or other substance inside the chamber to be compressed and thence conveyed or pumped through conduit 32 and openings 34 onto surface 20 in the region of the base of bristles 18 provided on the head 18 of the toothbrush apparatus.

Toward this end, and as substantially shown, connecting rod 50 is suitably affixed to the inside rear surface 56 of end cap 46 and axially extends through a central opening 58 in shank 42. Opening 58 is slightly larger than the diameter of connecting rod 52 so that movement of end cap 46 to the left relative to plug member 38 as viewed in FIG. 4 causes the connecting rod to slide within opening 58 relative to shank 42 and plug member 38, and consequently causes piston 52 likewise to displace a predetermined distance to the left relative to chamber 30 and handle 12. The forgoing predetermined distance is indicated by the axial distance "d" shown in FIG. 4 and is the distance the end cap 46 is axially displaceable on shank 42 between the shoulder 60 defined by the rearward facing radial surface of plug member 38 on the one hand, and the radially extending inside annular surface of inside end 62 of end cap 46 on the other hand.

It will be observed that the inside end 62 of end cap 46 has a central opening 64 slightly larger than the diameter of shank 42. By this arrangement, end cap 46 is captured on flange 44, but free to axially displace on shank 42 the distance "d." A coil spring 66 disposed within end cap 46 between flange 44 and inside rear surface 56 resiliently biases the end cap in the position shown in FIG. 4, i.e. the "normal" disposition of these parts. Displacement of end cap 46 in the foregoing manner is effected by selectively pressing the end cap toward shoulder 60 against the resilient biasing force generated by coil spring 66.

Piston 52 has a central opening 68 through which connecting rod 50 coaxially extends and the piston is captured on connecting rod 50 by a "one-way" friction clutch in the form of a cantilevered spring dip 70 which is suitably anchored in a slot 72 located in the face of piston 52 and offset with respect to the piston's central axis as seen to best advantage in FIG. 6. The free end of spring clip 72 arcuately extends at a slight angle to the connecting rod and is intercepted by same by means of an opening 74 provided in spring clip 70 through which the connecting rod extends.

In accordance with an important feature of the present invention, connecting rod 50 is adapted to slide relative to spring clip 70 through opening 74 only to the right as viewed in FIG. 4; that is, when the connecting rod 50 is returned to its normal position under the influence of the resilient biasing force of coil spring 66 and after the end cap 46 has been displaced the distance "d" to the left. Because of the offset cantilevered mounting of spring clip 70 on piston 52 and the slight tilt angle the spring clip makes to an orthogonal plane passing through and normal to the connecting rod's longitudinal axis, movement of the connecting rod to the left as viewed in FIG. 4 will frictionally engage the spring clip and cause slight flexure of the cantilevered spring downward and to the left thereby locking the piston onto the connecting rod and causing the piston to move concomitantly to the left the same distance connecting rod 50 is caused to displace to the left (FIG. 4) by selective actuation of end cap 46 as previously described.

However, when the connecting rod is caused to move back to the right under the influence of coil spring 66, as by releasing end cap 46, the spring clip 70 will be flexed to a slightly more upright position in the direction of piston 52 thereby allowing the connecting rod to slide freely relative to the spring clip through the opening 74 (i.e. to the right as viewed in FIG. 4). Hence, after several cycles of operation of actuator assembly 32, piston 52 will advance along the extent of connecting rod 50 from right to left (FIG. 4) a distance equal to N×"d" where N is equal to the number of such cycles. Of course, after a predetermined number of cycles the piston will engage the conical end of chamber 30 and any toothpaste or other substance originally stored in chamber 30 will have been substantially exhausted through conduit 32 and openings 34 at which juncture the toothbrush apparatus may be disposed of in a convenient manner.

It is thus seen that a predetermined quantity of toothpaste or other dentifrice will be pumped or delivered from chambered 30 to the bristles of the toothbrush apparatus through openings 34 each time the end cap 46 is actuated by causing it to move against coil spring 66 a distance "d." It will be further apparent that a smaller quantity of toothpaste may be delivered to the bristles by selectively actuating the end cap a lesser distance than "d," when and as desired.

Figure 8:
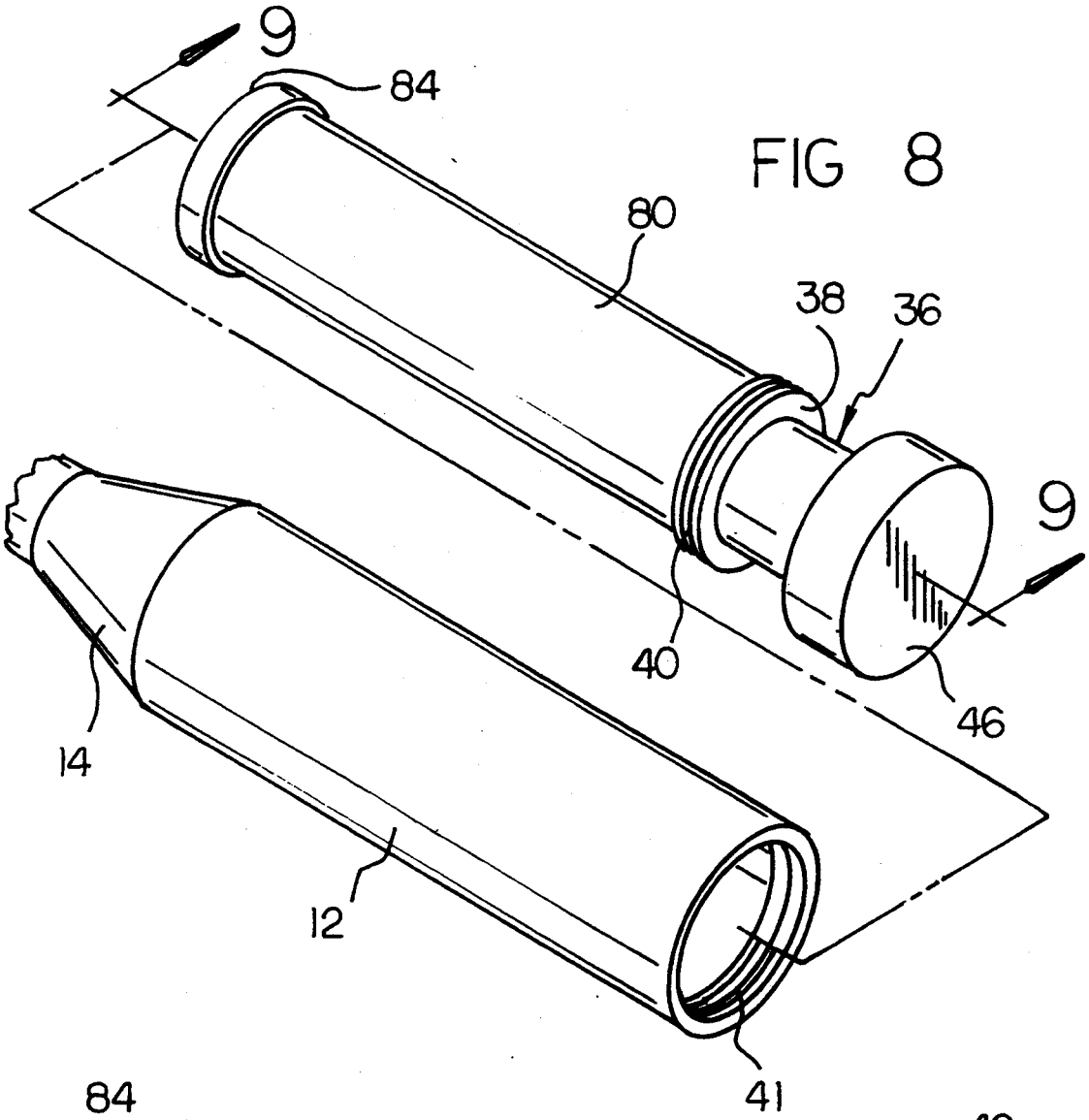
FIG. 8 is an exploded assembly showing the refillable cartridge and handle of the alternative embodiment of the invention.
Figure 9:
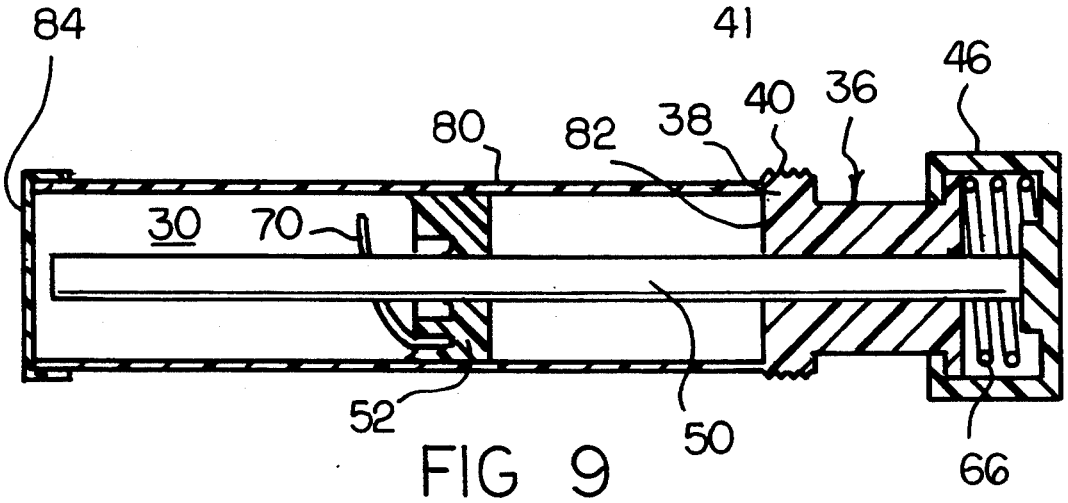
FIG. 9 is a cross-sectional view in elevation taken along line 9—9 of FIG. 8.

Turning now to FIGS. 7 through 9 there is shown a slightly modified alternatively preferred embodiment of the invention wherein the actuator assembly is combined with an integral sleeve to form a replacement cartridge and wherein like reference numerals refer to like parts already described.

More specifically, an elongated hollow cylindrical sleeve 80 of reduced diameter compared to cylindrical handle 12 is suitably integrally joined at one end to end face 82 of plug 38, and is provided with a tight fitting removable sealing cap 84 affixed to its other or opposite end, substantially as shown. The interior of hollow sleeve 80 is charged with toothpaste or other dentifrice, cleaning substance, etc. As before, the male threads 40 on the periphery of plug member 38 cooperate with female threads 41 located on the inside surface of handle 12 near its second or rearwardly facing end so that following removal of cap 84 the cartridge or sleeve 80 may be inserted inside hollow handle in a coaxial manner and fixed in place by rotating sleeve 80 and actuator assembly 36 relative to handle 12 until the parts are tightly joined together and the cartridge is nested coaxially inside the handle. Once, the cartridge is in place, actuator assembly 36 may be operated in the same manner as described above in connection with the embodiment of FIGS. 1 through 6 to deliver predetermined amounts of toothpaste or other cleaning substance from the interior of chamber 30 to the bristles 28 on the head 18 of the toothbrush apparatus. When a cartridge is depleted, it may simply be removed and disposed of and replaced by another cartridge containing a fresh supply of dentifrice.

The parts of the disposable toothbrush apparatus of the invention may be made from durable materials such as molded plastic, or metal, or combinations thereof.

It is apparent from the above that the present invention accomplishes all of the objectives set forth by providing a new and improved toothbrush apparatus comprising a head, a bristle cluster extending from the head and a hollow handle for defining a toothpaste storage chamber connected to the head. A manually actuatable pump assembly mounted for axial displacement at the distal end of the handle storage chamber is adapted to cause a predetermined amount of toothpaste in the chamber to be fed via a conduit to a nozzle opening in a surface of the head at the base of the bristle cluster. In an alternative embodiment, a refillable cartridge containing a fresh supply of toothpaste and the self-contained pump assembly is adapted to be fitted to the hollow handle. The foregoing apparatus as disclosed achieves the following advantages: (1) it is simple in construction, having relatively few parts, and thereby low in cost; (2) it is capable of storing a sufficient amount of toothpaste suitable for several applications; (3) it comprises a convenient and simple actuator for repeatedly and selectively transferring a predetermined amount of the stored toothpaste quantity to the bristles for each cleaning cycle; (4) it is capable of being easily recharged with a fresh supply of toothpaste to permit, if desired, reuse; and (5) it is durable, yet light in weight and compact in size.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

What is claimed as being new and desired to be protected by Letters Patent of the United States is as follows:

1. A disposable toothbrush apparatus comprising:

an elongated handle having first and second ends, said handle being hollow to define an interior storage space for receiving a dentifrice, a head connected to said handle first end, bristles supported on said head, a conduit extending between said head and said interior storage space, actuator means on said second end of said handle for selective actuation between a first position and a second position, said actuator means including an elongated rod projecting into said interior storage space and extending longitudinally and axially through an extent of said interior storage space from said second end of said handle toward said first end of said handle;

a piston positioned within said interior storage space for dividing said interior storage space into a first compartment in communication with said conduit and a second compartment in communication with said second end of said handle, said piston having a central opening extending therethrough, said piston being slidably positioned on said elongated rod such that said elongated rod projects through said central opening thereof; and, a one-way clutch means secured to said piston for engaging said elongated rod in response to an actuation of said actuator means from said first position to said second position, said one-way clutch means comprising a cantilevered spring clip eccentrically secured to said piston within said first compartment, said spring clip arcuately extending from said elongated rod and terminating in a free distal end, said spring clip including a spring clip opening extending therethrough proximal to said free distal end thereof, with said elongated rod projecting through said spring clip opening and frictionally engaging a periphery of said spring clip opening, whereby a movement of said elongated rod of said actuator means in a first direction from said first position to said second position biases said free distal end of said spring clip away from said piston such that said periphery of said spring clip opening fixedly engages an exterior surface of said elongated rod to pull said piston through said interior storage space towards said handle first end to decrease a volume of said first compartment.

2. The toothbrush apparatus of claim 1, wherein said actuator means further includes plug means for fixedly attaching said actuator means to said second handle end.

3. The toothbrush apparatus of claim 2, wherein said plug means includes a central opening therein aligned with the longitudinal axis of said elongated handle, said plug means further including an axially extending shank having a central opening aligned with said central opening in said plug means, an axially depressible end cap mounted on said shank for movement between first and second positions, said end cap having said elongated rod attached thereto, said elongated rod extending through said opening in said shank and said opening in said plug means to extend into said interior storage space.

4. The toothbrush apparatus of claim 3, wherein said actuator means further includes resilient biasing means interposed between said shank and said end cap for resiliently biasing said end cap of said actuator means towards said first position.

5. The toothbrush apparatus of claim 4, wherein said head extends from said handle and includes at least one flat bristle supporting surface, said bristle supporting surface having at least one opening therein, said at least one opening therein communicating with said conduit.

6. The toothbrush apparatus of claim 5, wherein said bristle supporting surface further includes a multiplicity of openings communicating with said conduit, said multiplicity of openings being shaped as sectors of a circle.

7. A disposable toothbrush apparatus comprising:

an elongated handle having first and second ends, said handle being hollow to define an interior storage space for receiving a dentifrice, a head connected to said handle first end, bristles supported on said head, a conduit extending between said head and said interior storage space, a hollow elongated sleeve having an open first end and an open second end, said elongated sleeve having a hollow elongated sleeve interior storage space and being positioned within said interior storage space of said handle such that said open second end is in communication with said interior storage space of said handle;

actuator means mounted to said first open end of said elongated sleeve for selective actuation between a first position and a second position, said actuator means including an elongated rod projecting into said elongated sleeve interior storage space and extending longitudinally and axially through an extent of said elongated sleeve interior storage space from said second end of said handle toward said first end of said handle;

a piston positioned within said elongated sleeve interior storage space for dividing said elongated sleeve interior storage space into a first compartment in communication with said conduit and a second compartment, said piston having a central opening extending therethrough, said piston being slidably positioned on said elongated rod such that said elongated rod projects through said central opening thereof; and, a one-way clutch means secured to said piston for engaging said elongated rod in response to an actuation of said actuator means from said first position to said second position, said one-way clutch means comprising a cantilevered spring clip eccentrically secured to said piston within said first compartment, said spring clip arcuately extending from said elongated rod and terminating in a free distal end, said spring clip including a spring clip opening extending therethrough proximal to said free distal end thereof, with said elongated rod projecting through said spring clip opening and frictionally engaging a periphery of said spring clip opening, whereby a movement of said elongated rod of said actuator means in a first direction from said first position to said second position biases said free distal end of said spring clip away from said piston such that said periphery of said spring clip opening fixedly engages an exterior surface of said elongated rod to pull said piston through said elongated sleeve interior storage space towards said handle first end to decrease a volume of said first compartment.

8. The toothbrush apparatus of claim 7, wherein said actuator means further includes plug means for fixedly attaching said actuator means to said second handle end.

9. The toothbrush apparatus of claim 8, wherein said plug means includes a central opening therein aligned with the longitudinal axis of said elongated handle, said plug means further including an axially extending shank having a central opening aligned with said central opening in said plug means, an axially depressible end cap mounted on said shank for movement between first and second positions, said end cap having said elongated rod attached thereto, said elongated rod extending through said opening in said shank and said opening in said plug means to extend into said interior storage space.

10. The toothbrush apparatus of claim 9, wherein said actuator means further includes resilient biasing means interposed between said shank and said end cap for resiliently biasing said end cap of said actuator means towards said first position.

11. The toothbrush apparatus of claim 10, wherein said head extends from said handle and includes at least one flat bristle supporting surface, said bristle supporting surface having at least one opening therein, said at least one opening therein communicating with said conduit.

12. The toothbrush apparatus of claim 11, wherein said bristle supporting surface further includes a multiplicity of openings communicating with said conduit, said multiplicity of openings being shaped as sectors of a circle.

* * * * *